US007396215B2

(12) United States Patent
Ozawa et al.

(10) Patent No.: US 7,396,215 B2
(45) Date of Patent: Jul. 8, 2008

(54) WATER PUMP

(75) Inventors: Yasuo Ozawa, Kariya (JP); Yojiro Koga, Kariya (JP); Atsushi Chiba, Toyoake (JP); Itsuro Hashiguchi, Chiryu (JP)

(73) Assignee: Aisin Seiki Kabushiki Kaisha, Aichi-ken (JP)

( * ) Notice: Subject to any disclaimer, the term of this patent is extended or adjusted under 35 U.S.C. 154(b) by 414 days.

(21) Appl. No.: 11/104,516

(22) Filed: Apr. 13, 2005

(65) Prior Publication Data

US 2005/0238511 A1 Oct. 27, 2005

(30) Foreign Application Priority Data

Apr. 27, 2004 (JP) ..... 2004-130536
Apr. 27, 2004 (JP) ..... 2004-130537

(51) Int. Cl.
*F01P 5/00* (2006.01)
*F01P 5/12* (2006.01)
*F04D 29/10* (2006.01)

(52) U.S. Cl. ..... 417/362; 417/423.15; 417/313; 415/111; 415/168.2; 416/60

(58) Field of Classification Search ..... 417/362, 417/423.11, 423.14, 423.15, 313; 415/111; 416/60
See application file for complete search history.

(56) References Cited

U.S. PATENT DOCUMENTS

| | | | | |
|---|---|---|---|---|
| 4,966,572 | A | 10/1990 | Kunkel et al. | |
| 5,779,449 | A * | 7/1998 | Klein | 416/244 R |
| 6,200,089 | B1 | 3/2001 | Heer | |
| 6,561,756 | B2 * | 5/2003 | Ozawa et al. | 415/111 |
| 6,561,770 | B2 * | 5/2003 | Okuda | 417/223 |
| 2003/0175133 | A1 * | 9/2003 | Koga et al. | 417/362 |

FOREIGN PATENT DOCUMENTS

| | | |
|---|---|---|
| GB | 2 223 274 A | 8/1989 |
| JP | 2003-314491 | 2/2003 |
| JP | 2003-314491 | 2/2006 |

OTHER PUBLICATIONS

Extended European Search Report for 05008182.7-1267 dated Dec. 21, 2007.

* cited by examiner

*Primary Examiner*—Devon C. Kramer
*Assistant Examiner*—Leonard J Weinstein
(74) *Attorney, Agent, or Firm*—Reed Smith LLP; Stanley P. Fisher, Esq.; Juan Carlos A. Marquez, Esq.

(57) ABSTRACT

A water pump comprises a pump body, a cylindrical supporting portion, a pulley, a shaft portion, an impeller, a seal member, a pulley cylinder portion, a wall portion, a through-hole formed, a cover covering the wall portion and the pulley cylinder portion of the pulley from one side of the pulley, and the cover formed in a cylindrical shape with a bottom portion and including a reservoir for receiving fluid that has leaked through the seal member.

9 Claims, 11 Drawing Sheets

WATER PUMP

This application is based on and claims priority under 35 U.S.C. § 119 to Japanese Patent Application 2004-130537 and 2004-130536, filed on Apr. 27, 2004, the entire content of which is incorporated herein by reference.

FIELD OF THE INVENTION

This invention relates to a water pump for cooling an engine.

BACKGROUND

A known water pump, disclosed in, for example JP2003-314491A, includes a pulley, a shaft portion, an impeller, a body, a bearing, a mechanical seal and a cover. Specifically, the shaft portion rotates integrally with the pulley, the impeller rotates integrally with the shaft portion, the body includes an approximate cylindrical supporting portion into which the shaft penetrates, the bearing is provided between an outer peripheral surface of the supporting portion and an inner peripheral surface of the pulley so as to rotatably support the pulley, the mechanical seal seals a space formed between an outer peripheral surface of the shaft portion and an inner peripheral surface of the supporting portion at one end of the space.

Further, a drain hole is formed on a front wall of the pulley in order to drain vaporized coolant or micro-stillformed coolant, which has leaked through the mechanical seal, to an atmosphere side. The cover, being cylindrical having a bottom, is fixed to a front surface of the pulley so as to cover the front wall of the pulley.

According to such the known water pump, vaporized coolant or micro-stillformed coolant has leaked through the mechanical seal, passed through a drain hole and been drained into the cover, and then the coolant gelates and adheres to an inner peripheral surface of the cover so as to prevent the coolant from being spattered. Further, by use of the cover, it can be prevented that foreign objects come into shaft portion.

However, in such the configurations, because the gelated coolant cannot stay inside the cover, the gelated coolant may flow outside the cover, and further, ethylene glycol, which has been colored and included in the antifreezing fluid mixed into the coolant, may be adhere to the front surface of the pulley, as a result, the mechanical seal may be recognized as being damaged, in addition, level of the outer appearance of the water pump can be decreased.

Thus, a need exists for providing a water pump in which fluid leaked through a seal member can be prevented from flowing out of a cover.

SUMMARY OF THE INVENTION

According to an aspect of the present invention, a water pump comprises a pump body including a pump chamber, a bearing, a cylindrical supporting portion formed on the pump body so as to protrude, a pulley rotatably supported by the cylindrical supporting portion on the pump body by means of the bearing so as to rotate relative to the cylindrical supporting portion, a shaft portion, including first and second end portions, formed on the pulley so as to penetrate a central hole of the cylindrical supporting portion and extend as far as the pump chamber of the pump body, an impeller provided as a unit at the second end portion of the shaft portion, a seal member provided between an inner peripheral surface of an end portion of the cylindrical supporting portion at the pump body side and an outer peripheral surface of the second end portion of the shaft portion of the pulley, a pulley cylinder portion of the pulley to which an outer ring of the bearing is engaged, a wall portion connecting the pulley cylinder portion with the first end portion of the shaft portion, a through-hole formed on the wall portion so as to be capable of being penetrated in an axial direction thereof, a cover covering the wall portion and the pulley cylinder portion of the pulley from one side of the pulley, and the cover formed in a cylindrical shape with a bottom portion and including a reservoir for receiving fluid that has leaked through the seal member.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
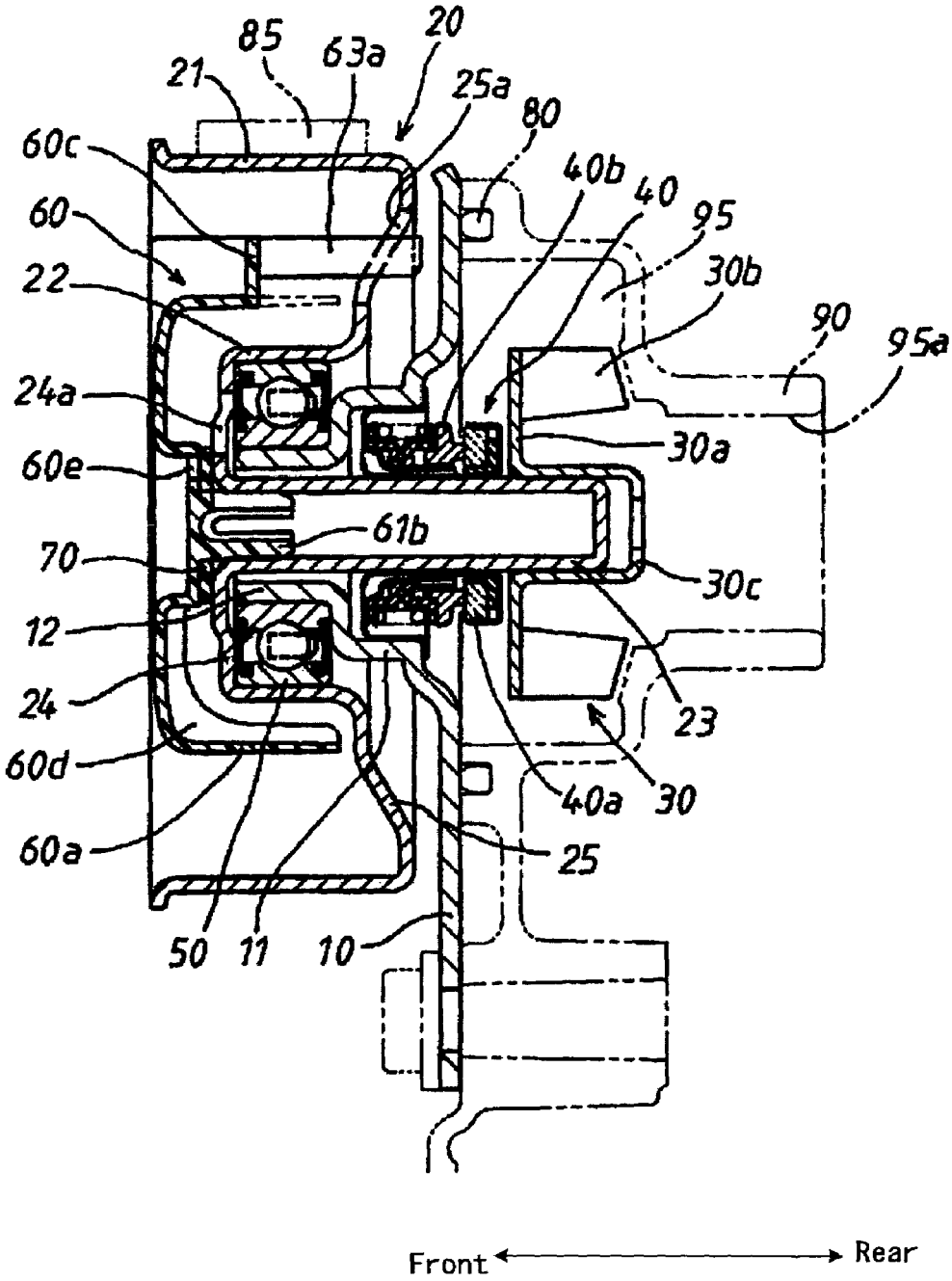
FIG. 1 illustrates a vertical section of the water pump according to a first embodiment of the present invention.
Figure 2:
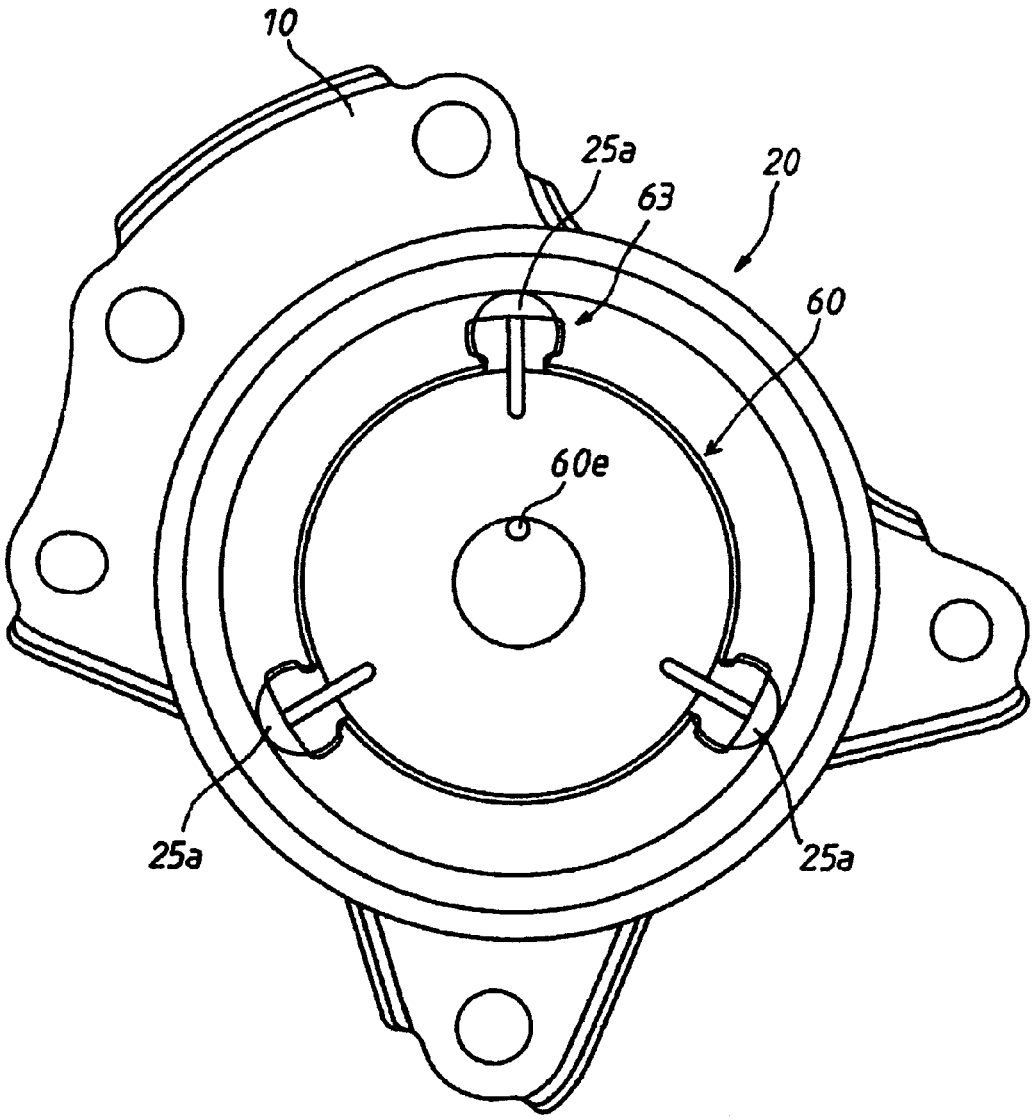
FIG. 2 illustrates a front view of the water pump shown in FIG. 1.
Figure 3:
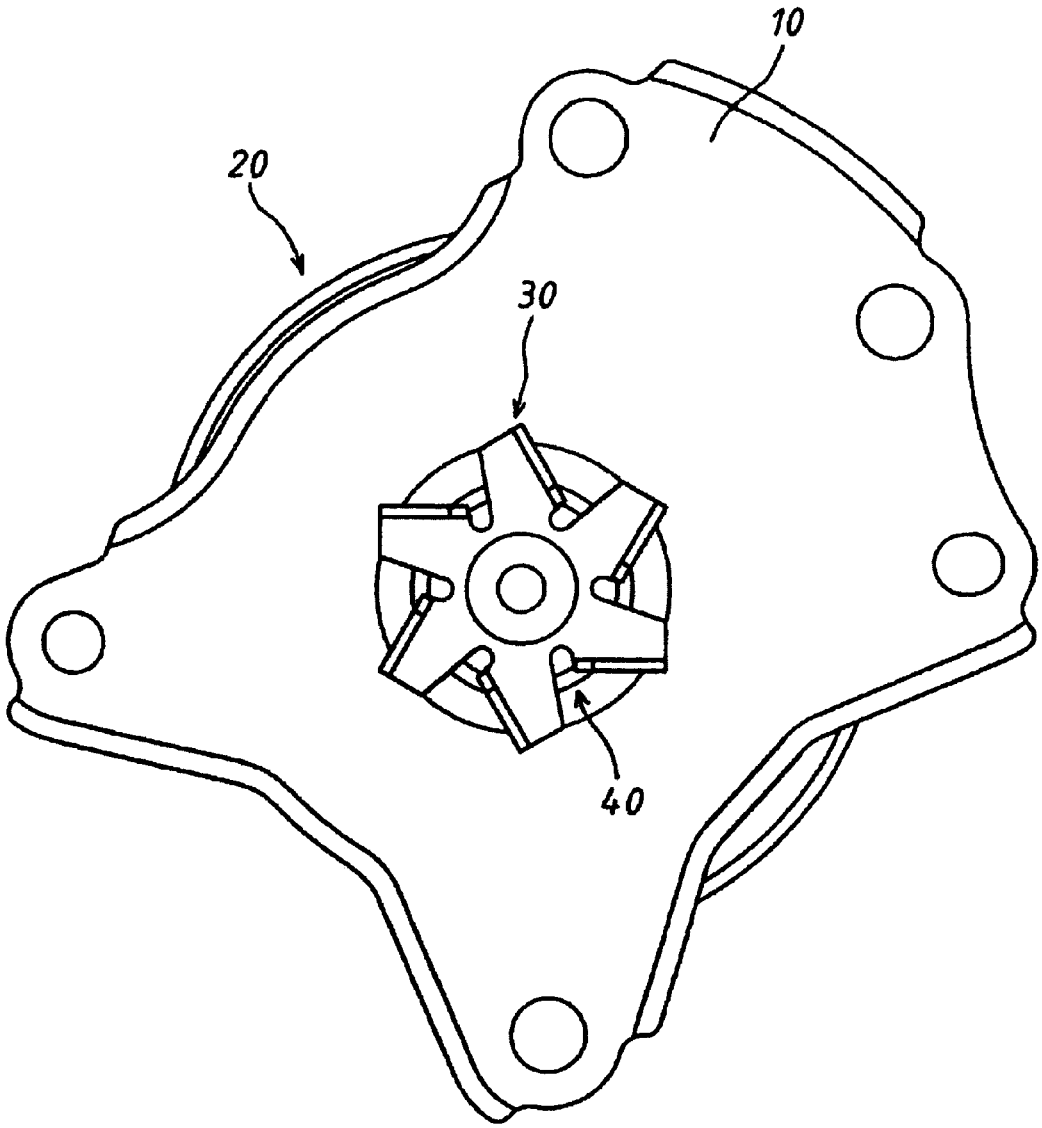
FIG. 3 illustrates a rear view of the water pump shown in FIG. 1.
Figure 4:
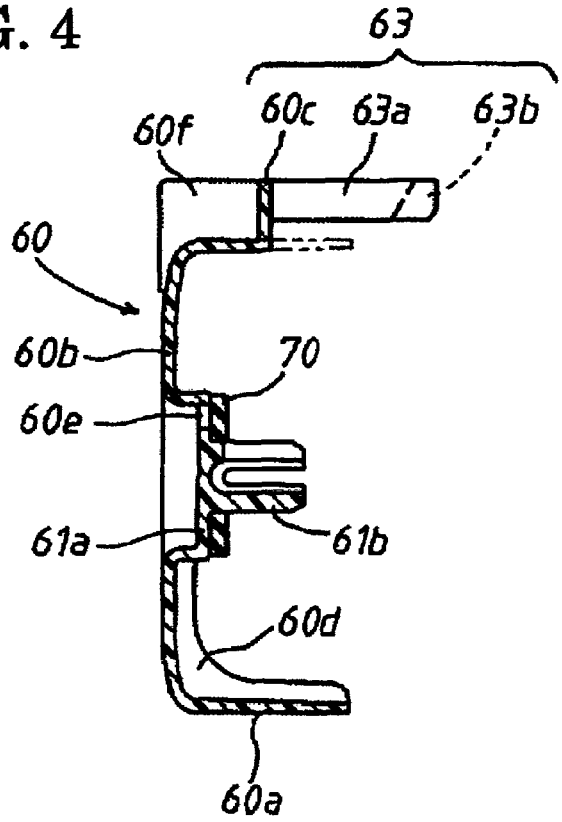
FIG. 4 illustrates a section view of a cover shown in FIG. 1.
Figure 5:
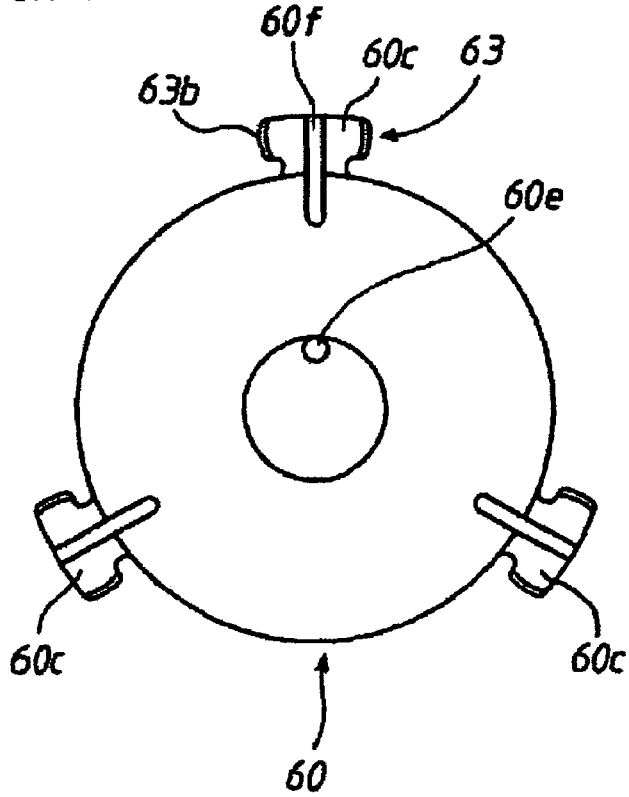
FIG. 5 illustrates a front view of the cover shown in FIG. 4.

An example where a water pump related to a first embodiment of the present invention is applied to a water pump for cooling an engine will be explained in accordance with FIGS. 1 through 6. In FIGS. 1, 2 and 3, by means of a fixing means such as a bolt, a pump body 10 of the water pump is fixed to a pump unit 90 provided on the engine body, in circumstances where a seal member 80 is provided therebetween.

On an approximate central portion of the pump body 10, a cylindrical-first supporting portion 11 (cylindrical supporting portion) and a cylindrical-second supporting portion 12 (cylindrical supporting portion) are formed. Specifically, the first supporting portion 11 is formed so as to be protruding in a front direction (leftwards in FIG. 1), and the second supporting portion 12, having a diameter that is smaller than a diameter of the first supporting portion 11, is formed so as to be further protruding in the front direction (leftwards in FIG. 1) continuously from the front end of the first supporting portion 11.

The pump body 10 is formed of a steel plate by press molding so as to have the first supporting portion 11 and the second supporting portion 12 concentrically, and then the pump body 10 is plated or painted in order to apply corrosion resistance thereto. A pulley 20 is rotatably supported by means of a bearing 50 to an outer peripheral surface of the second supporting portion 12 of the pump body 10. The pulley 20 includes a belt hook portion 21, a bearing supporting portion 22 (pulley cylinder portion) and a shaft portion 23.

As shown in FIG. 1 the shaft portion 23, formed on a central portion of the pulley 20 in a cylindrical shape having an opening on its front end and a bottom portion on its rear end, is protruding rightwards in FIG. 1 so as to penetrate through center holes of the first supporting portion 11 and the second supporting portion 12.

The bottom portion of the shaft portion 23 extends as far as a pump chamber 95 that will be described later. On an outer peripheral surface near the opening of the shaft portion 23, the bearing supporting portion 22 is formed so as to be in a cylindrical shape. As shown in FIG. 1, a front end of the bearing supporting portion 22 is connected to a front portion (first end portion) of the shaft portion 23 with a front wall portion 24 (wall portion).

The cylindrical-bearing supporting portion 22 has a diameter that is larger than a diameter of the shaft portion 23, in circumstances where a central point of the bearing supporting portion 22 is identical with a central point of the shaft portion 23. Plural through-holes 24*a*, in which a press fitting tool inserts, are formed equally spaced on the circumference of the front wall portion 24. In the first embodiment, three through-holes 24*a* are formed on the front wall portion 24 of the pulley 20. On the outer circumferential of the bearing supporting portion 22, the belt hook portion 21 is formed in a cylindrical shape so as to have a central point that is identical with the central point of the bearing supporting portion 22. A diameter of the belt hook portion 21 is larger than that of the bearing supporting portion 22.

As shown in FIG. 1, a rear end of the belt hook portion 21 is connected to a rear end of the bearing supporting portion 22 with a rear wall portion 25 formed in a disc shape. Specifically, the rear wall portion 25 is formed in a conical shape, and whose diameter gradually expands toward a rear direction thereof. On the rear wall portion 25, engagement hole portions 25*a*, with which leg portions 63*a* of the cover 60 are engaged, are formed equally spaced on the circumference of the rear wall portion 25. In this embodiment, three engagement hole portions 25*a* are formed on the rear wall portion 25.

In such the circumstances, the pulley 20 is integrally comprised of the belt hook portion 21, the rear wall portion 25, the bearing supporting portion 22, the front wall portion 24 and the shaft portion 23. The pulley 20 is formed of a steel plate by press molding so as to have the belt hook portion 21, the bearing supporting portion 22 and the shaft portion 23 concentrically, and then the pulley 20 is plated or painted in order to apply corrosion resistance thereto.

To a rear portion (second end portion) of the shaft portion 23, an impeller 30 is fixed so as to be able to integrally rotate. The impeller 30 includes a base portion 30*a*, plural blades 30*b* and a hollow protrude portion 30*c*. The blades 30*b* protrude from a rear end surface of the base portion 30*a*, and the hollow protrude portion 30*c* protrudes rightwards from a central portion of the base portion 30*a*.

The hollow protrude portion 30*c* is fitted to the rear end portion of the shaft portion 23 so as to be engaged with the outer peripheral surface of the shaft portion 23, and thus the impeller 30 is fixed to the rear end portion of the shaft portion 23 so as to be able to integrally rotate. The impeller 30 may be plated or painted in order to apply corrosion resistance thereto.

The impeller 30 is provided within a pump chamber 95, which is formed within a pump unit 90 by use of the pump body 10 covering an opening portion of the pump unit 90, and the pump chamber 95 comprises an engine coolant circuit (not shown). A mechanical seal 40 (seal member), serves as a seal member, is provided between an inner peripheral surface of the first supporting portion 11 of the pump body 10 and the outer peripheral surface of the shaft portion 23. The mechanical seal 40 is comprised of a rotation ring 40*a* and an engaging ring 40*b*.

The rotation ring 40*a* is fixed to the outer peripheral surface of the rear end portion of the shaft portion 23 so as to seal the pump chamber 95, and the engaging ring 40*b* is attached to the inner peripheral surface of the first supporting portion 11 so as to seal the pump chamber 95. The engaging ring 40*b* is pressed to the rotation ring 40*a* by means of a spring force of a compression spring. In such the configurations, the engaging ring 40*b* rotates relative to the rotation ring 40*a* and at the same time, the pump chamber 95 is sealed by means of the engaging ring 40*b* and the rotation ring 40*a*. When the shaft portion 23 rotates, the mechanical seal 40 seals the pump chamber 95 with maintaining a liquid film on sliding portions between the rotation ring 40*a* and the engaging ring 40*b*.

The bearing 50, provided between the outer peripheral surface of the second supporting portion 12 of the pump body 10 and the inner peripheral surface of the bearing supporting portion 22, is comprised of a sealed bearing. An inner ring of the bearing 50 is fitted to the outer peripheral surface of the second supporting portion 12, and an outer ring of the bearing 50 is fitted to the inner peripheral surface of the bearing supporting portion 22. The bearing 50 is mounted between the pump body 10 and the pulley 20 as follows. First, the bearing 50 is inserted into the cylindrical portion of the bearing supporting portion 22 in circumstances where the outer ring of the bearing 50 is fitted to the inner peripheral surface of the bearing supporting portion 22. Then, the bearing 50 fitted to the inner peripheral surface of the bearing supporting portion 22 is further fitted to the outer peripheral surface of the second supporting portion 12 at the inner ring of the bearing 50. In this process, the inner ring of the bearing 50 is directly pressed by means of a press fitting tool inserted through the through-hole 24*a* formed on the pulley 20 so as to be fitted to the outer peripheral surface of the second supporting portion 12 of the pump body 10. Thus, pressure is not applied to a ball of the bearing while the bearing 50 is mounted, as a result it can be prevented that duration of life of the bearing 50 is reduced due to such the pressure.

Further, in this embodiment, three through-holes 24*a* are long holes so as to be curved along the inner ring of the bearing 50. Comparing to the case when four-circle holes are formed as the through holes 24*a*, even when a total area of three openings of the three holes are same as a total area of four openings of the four holes, engaging areas between the press fitting tool and the inner ring can be large through by means of the three long through-holes 24*a*, and thus force can be applied equally to the inner ring of the bearing by means of the press fitting tool.

As shown in FIG. 1, a cover 60 formed of resin in a cylindrical shape having a bottom portion is provided in front of the pulley 20 so as to cover the bearing supporting portion 22 of the pulley 20 and the front wall portion 24. As shown in detail in FIGS. 4 to 6, the cover 60 includes a cylinder portion 60*a* (cover cylinder portion), a bottom portion 60*b* and a bottom surface boss portion 61*a*. The cylinder portion 60*a* is formed on an outer peripheral portion of the cover 60 so as to extend in a rear direction, and the bottom surface boss portion

61*a* is formed on a central portion of the bottom portion 60*b* so as to protrude slightly in a rear direction.

Figure 6:
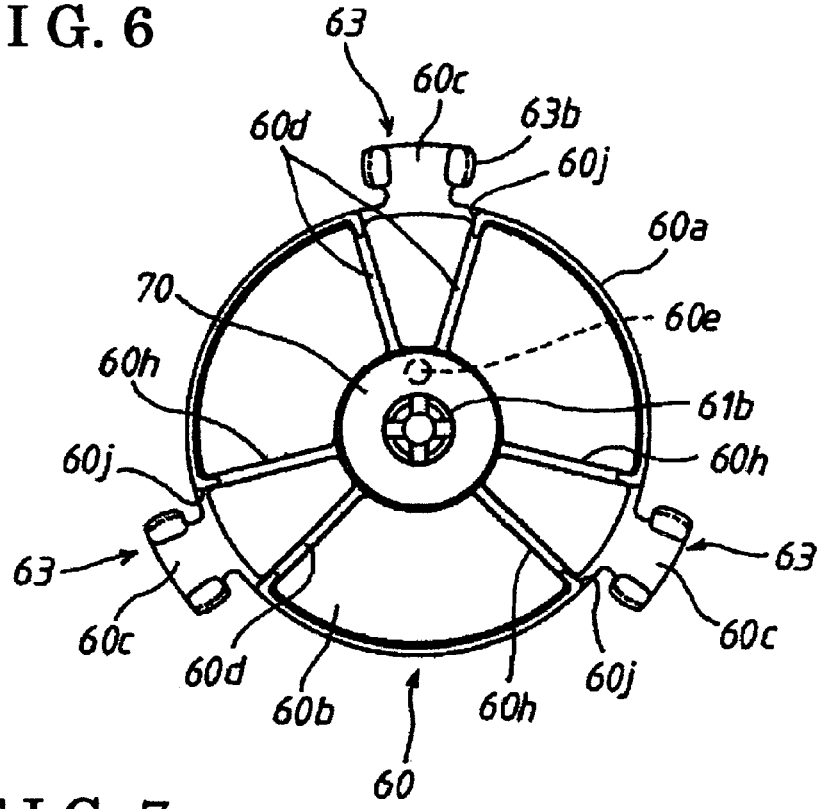
FIG. 6 illustrates a rear view of the cover shown in FIG. 4.

As shown in FIG. 6, U-shaped notches 60*j* are formed on the cylinder portion 60*a* of the cover 60, and outward of the notches 60*j*. Attaching portions 63, serving as a first attaching portion, are formed so as to be engaged with the engagement hole portions 25 formed on the pulley 20. In this embodiment, three notches 60*j* are formed on the cylinder portion 60*a* of the cover, and three attaching portions 63 are formed outward of the notches 60*j*. As shown in FIG. 6, the attaching portion 63 is comprised of a base portion 60*c*, the leg portion 63*a* and an engaging portion 63*b*. The base portions 60*c* are formed so as to extend from the notches 60*j* of the cylinder portion 60*a* in a radial direction of the cover 60. The leg portions 63*a*, formed in board shape in two rows, extends from the base portion 60*c* in the same direction as a extending direction of the cylinder portion 60*a*, and further the engaging portions 63*b* are formed in pairs at top end portions of the leg portions 63*a* so as to protrude in a circumferential direction of the cover 60. Each of the engaging portions 63*b* extends opposite directions.

The engaging portion 63*b* is inserted into the engagement hole portion 25*a* of the pulley 20 so as to be elastically engaged therewith in circumstances where the leg portions 63*a* is elastically deformed. Plural attaching portions 63 are formed on the cover 60 outer the cylinder portion 60*a*. In this embodiment, three attaching portions 63 are formed equally spaced in a circumferential direction the cover 60. Further, an insert portion 61*b* is formed at the central portion of the bottom surface boss portion 61*a* of the cover 60. The insert portion 61*b* is engaged with the opening of the shaft portion 23, and in such the circumstances, the insert portion 61*b* serves as a second attaching portion.

The insert portion 61*b*, formed in an approximate cylindrical shape, has notches formed from the top end of the insert portion 61*b* in an axial direction so as to be elastically deformable in a radial direction of thereof. An outer diameter of the insert portion 61*b* is slightly larger than the inner diameter of the opening portion of the shaft portion 23, and thus, when the cover 60 is not mounted to the pulley 20, the insert portion 61*b* is inserted into the shaft portion 23 so as to be elastically engaged therewith. A small through-hole 60*e* for confirmation of a presence of an elastic member is formed on the bottom surface boss portion 61*a* at a biased position relative to a central portion thereof in a radial direction so as to penetrate through the bottom surface boss portion 61*a* of the cover 60.

As shown in FIG. 6, ribs 60*d* (reservoir) are formed so as to radially extend from an outer peripheral portion of the bottom surface boss portion 61*a* to the notches 60*j*. Specifically, each of the ribs 60*d* extends continually to each of vertical portions of the notches 60*j*. More specifically, the ribs 60*d* are formed on the backside of the bottom portion 60*b*, extending in an radial direction and protruding in an axial direction from the back side of the bottom portion 60*b*, and further the ribs 60*d* are continually formed on an inner peripheral surface of the cylinder portion 60*a* of the cover 60, extending in an axial direction thereof and protruding in a radial direction from the inner peripheral surface of the cover. The length of the cylinder portion 60*a* in an axial direction is set at an appropriate length in order to form practically no space between the pulley 20 and the cover 60 when the cover 60 is mounted to the pulley 20. As mentioned above, the notches 60*j* are formed between the ribs 60*d* on the cylinder portion 60*a* outside which the base portions 60*c* of the attaching portions 63 are formed. In such the configurations, a molding tool for the cover 60 can be simplified in a manner where portions for forming a part of the outer peripheral surface, which relates to the paired leg portions 63*a*, are not formed so as to enhance a duration of life of the molding tool. Thus, the more the size of the pulley 20 becomes small, the more the notch 60*j* needs to be provided on the cylinder portion 60*a* outside which the attaching portion 63 is provided.

Further, because of the ribs 60*d* formed on the backside of the bottom portion 60*b* and the backside of the cylinder portion 60*a*, the strength of entire the cover 60 can be enhanced, especially the strength of the cylinder portions 60*a* at which the notches 60*j* are formed can be enhanced, and thus, the value of the thickness of the cover 60 can be reduced, as a result, the weight and the costs of the cover 60 can be reduced. Furthermore, when the weight of the cover 60 is lighten, an inertia of the pulley 20 becomes small, as a result, a level of wear on the engaging portion 63*b* because of relative rotations between the pulley 20 and the cover 60 can be reduced. In addition, gel-type ethylene glycol of antifreezing fluid, which has been mixed into vaporized coolant or micro-stilliformed coolant and leaked from the pump chamber 95, gathers on the wall surface 60*h* so as to prevent the gel-type ethylene glycol coming out of the pulley 20.

As mentioned above, because the pulley 20 rotates in one direction, each of the ribs 60*d* may be formed so as to extend toward only one wall portion of each of the notches 60*j*. Specifically, each of the ribs 60*d* may be formed between one of the through-hole 24*a* and one of the notches 60*j* formed behind the through-holes 24*a* in a rotational direction of the pulley 20. However, in circumstances where the two ribs 60*d* radially extends from the bottom surface boss portion 61*a* toward both wall portions of the notch 60*j*, while the cover 60 is mounted to the pulley 20, the ribs 60*d* are positioned at both ends of the through-hole 24, vaporizes coolant or micro-stilliformed coolant that has leaked from the pump chamber 95 can be appropriately received.

On each of the base portions 60*c*, a reinforcement rib 60*f* is formed on the opposite surface where the leg portion 63*a* is formed. Each of the reinforcement rib 60*f* extends in an opposite direction of the each of the leg portions 63*a*, and thus when the cover 60 is mounted to the pulley 20, the cover 60 is pressed into the pulley 20 by means of a pressing tool pressing at the reinforcement ribs 60*f*. Because the reinforcement ribs 60*f* are formed equally spaced in circumferential direction of the cover 60, pressing pressure applied by means of the pressing tool is equally applied to each of the leg portions 63*a*.

The cover 60 is fixed at plural portions on the circumference to the pulley 20 in configurations where the engaging portions 63*b* of the leg portions 63*a* are inserted into the engagement hole portions 25*a* so as to be elastically engaged therewith. Further, the insert portion 61*b* of the cover 60 is inserted into the opening portion of the shaft portion 23 so as to be elastically engaged therewith, and thus, the central portion of the cover 60 is fitted to the central portion of the pulley 20. Furthermore, in such the configuration where the opening portion of the shaft portion 23 is covered with the insert portion 61*b*, it can be prevented that foreign objects come into the shaft portion 23, and thus, even when the bottom portion inside the shaft portion 23 cannot be appropriately plated or painted in order to apply corrosion resistance, it can be prevented that the bottom portion inside the shaft portion 23 is rusted.

Between the bottom surface boss portion 61*a* of the cover 60 and the front wall portion 24 of the pulley 20, which forces the bottom surface boss portion 61*a*, a ring-shaped rubber sheet 70 (elastic member) is provided as a elastic member. As shown in FIG. 1, the rubber sheet 70 is pressed in an axial direction thereof and positioned between a rear surface of the bottom surface boss portion 61*a* and the front wall portion 24 of the pulley 20. In such the circumstances, the small through-hole 60*e* is covered by the rubber sheet 70 on the rear surface of the bottom surface boss portion 61*a*, and the rubber sheet 70 can be seen from a front surface of the bottom surface boss portion 61*a* through the through-hole 60*e* even after the cover 60 is mounted to the pulley 20. Thus, it can be easily prevented that the rubber sheet 70 has been missed to be attached to the bottom surface boss portion 61*a*.

Next, an actuation of the water pump according to the first embodiment will be explained. By means of a belt engaged with the belt hook portion 21 of the pulley 20, rotational force is transmitted from an output shaft of the engine (not shown) to the pulley 20 in order to rotate the pulley 20, and in accordance with the rotation of the pulley 20, the shaft portion 23 integrally formed with the pulley 20 rotates in a same direction as the rotational direction of the pulley 20. Then, the impeller 30 integrated with the shaft portion 23 of the pulley 20 rotates within the pump chamber 95 that is obstructed in the pump body 19.

Because the pump chamber 95 is filled with the coolant, the coolant is moved in an outer periphery of the impeller 30 by means of centrifugal force of the rotation of the impeller 30. Through such the pump action, within the pump chamber 95, a pressure near the central portion of the impeller 30 differs from a pressure near the outer periphery of the impeller 30, and because of such the difference of the pressures, the coolant is sucked into the pump chamber 95 through the inlet port 95*a* formed on the rotational axis of the impeller 30. The sucked coolant flows toward the outer periphery of the impeller 30, and then the coolant is provided, through an outlet port (not shown) that is formed at the outer peripheral portion, to each portions of the engine, which needs to be cooled. In such ways, the coolant is circulated.

In such the configurations, the mechanical seal 40 seals the pump chamber 95 with maintaining the fluid film at the sliding portion between the engaging ring 40*b* and the rotation ring 40*a*, and after the engine rotates for long hours, vaporized coolant or micro-stilliformed coolant has leaked through the mechanical seal 40, and the leaked vaporized coolant or micro-stilliformed coolant drains through a clearance between the shaft portion 23 and the second supporting portion 12 of the pump body 10, and finally the leaked vaporized coolant or micro-stilliformed coolant drains through the through-hole 24*a* into the cover 60 that rotates integrally with the pulley 20. The leaked vaporized coolant or micro-stilliformed coolant, which drains into the cover 60, gelates and adheres to the inner peripheral surface of the cylinder portion 60*a* by means of centrifugal force of the cover 60, and the gelating coolant gathers on the wall surface 60*h* of the rib 60*d*, finally, the gelating coolant is dried and reserved inside the cover 60. In this way, it can be prevented that the coolant flows outside the cover 60, and ethylene glycol which is colored and comprise the antifreezing fluid mixed into the coolant cannot be attached on the front surface of the pulley 20, as a result, the outer appearance of the water pump can be enhanced, and the merchantability can also be enhanced.

Further, the cover 60 is mounted to the front wall portion 24 of the pulley 20, and the pressed rubber sheet 70 is provided between the cover 60 and the front wall portion 24 of the pulley 20. Thus, the engaging portion 63*b* of the cover 60 made of resin engages with the engagement hole portion 25*a*, and even when the engaging portion 63*b* wears due to the rotational fluctuation of the pulley 20, rattling does not occur between the engaging portion 63*b* and the engagement hole portion 25*a* so as to prevent noise of the cover 60 knocking on the pulley 20. Further, vibration on the pulley 20, which is formed of a steel plate by pressing, can be absorbed by means of the rubber sheet 70, as a result, vibration on the cover 60 caused by the vibration of the rotational fluctuation of the pulley 20 can be effectively reduced.

Figure 7:
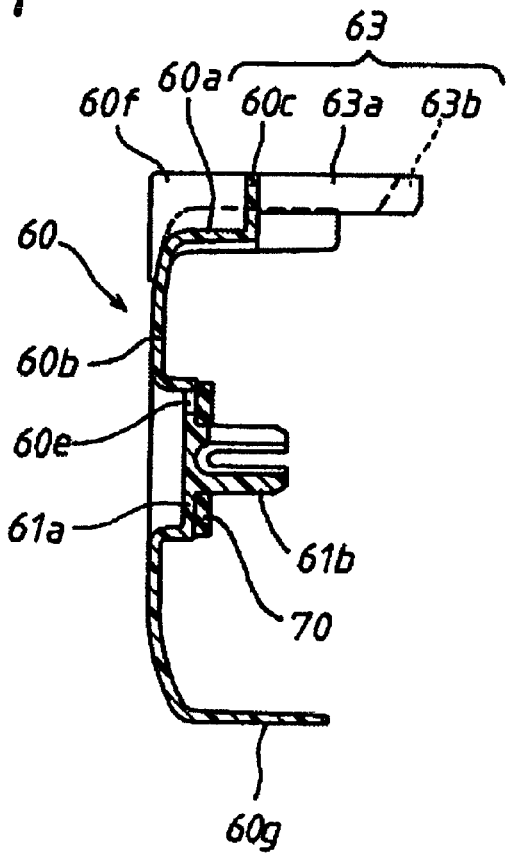
FIG. 7 illustrates a section view of the cover according to a second embodiment of the present invention.
Figure 8:
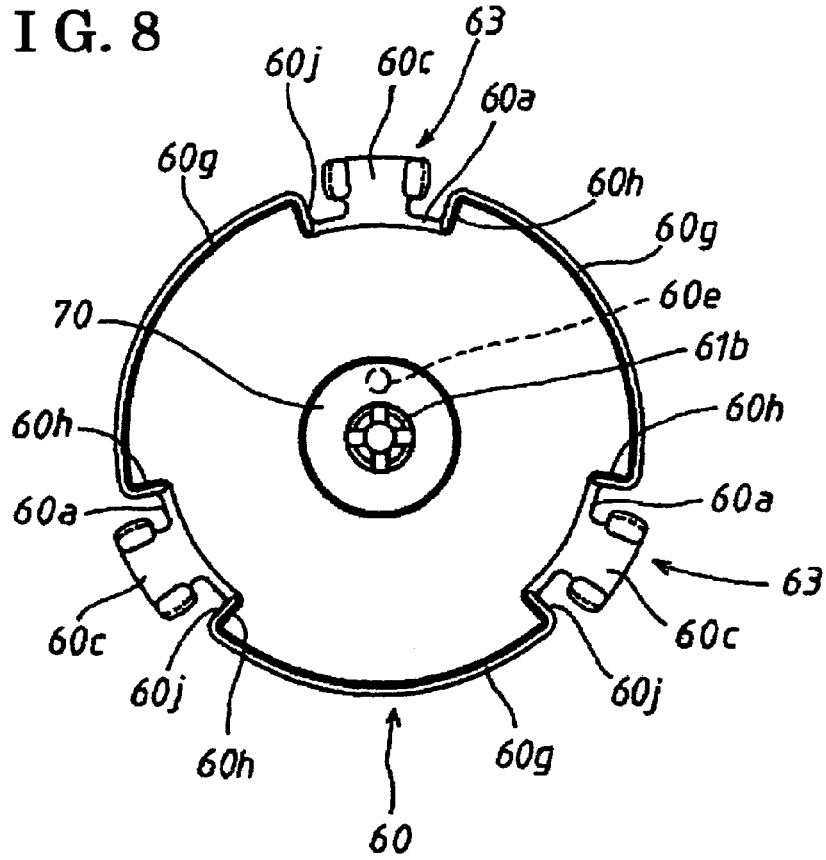
FIG. 8 illustrates a rear view of the cover shown in FIG. 7.

A cover used for a water pump according to a second embodiment will be explained in accordance with FIG. 7 and FIG. 8. The second embodiment basically has a similar structure to that of the first embodiment. The emphasis will be placed on an explanation of differences from the first embodiment. Specifically, in the second embodiment, the shape of the cover 60 differs from the cover 60 in the first embodiment, and second cylinder portions 60*g* are formed instead of the ribs 60*d* in the first embodiment. Specifically, in the second embodiment, the three second cylinder portions 60*g* are formed at spaces formed between each one of the three attaching portions 63. More specifically, as shown in a rear view in FIG. 8, the diameter of the cylinder portion 60*a* are increased within the spaces formed between each one of the three attaching portions 63 so as to form the three second cylinder portions 60*g*. Further, as show in FIG. 8, wall surfaces 60*h* are formed between both ends of each of the second cylinder portions 60*g* and the cylinder portion 60*a* so as to extend in a radial direction of the cover 60. The wall surfaces 60*h* serve as the ribs 60*d*, specifically, vaporized coolant or micro-stilliformed coolant and leaked from the pump chamber 95 through the mechanical seal 40 and attached on an inner peripheral surface of the second cylinder portion 60*g*, gathers on the wall surface 60*h* so as to prevent the gel-type ethylene glycol coming out of the pulley 20.

Figure 9:
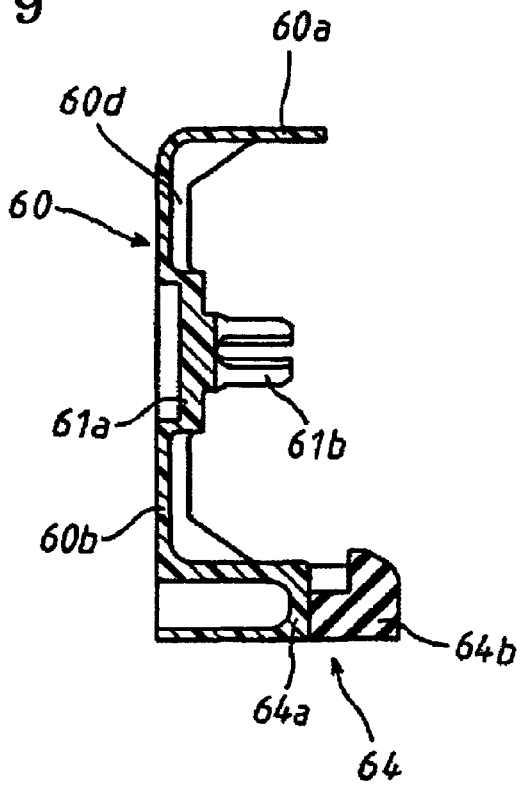
FIG. 9 illustrates a section view of the cover according to the third embodiment of the present invention.
Figure 10:
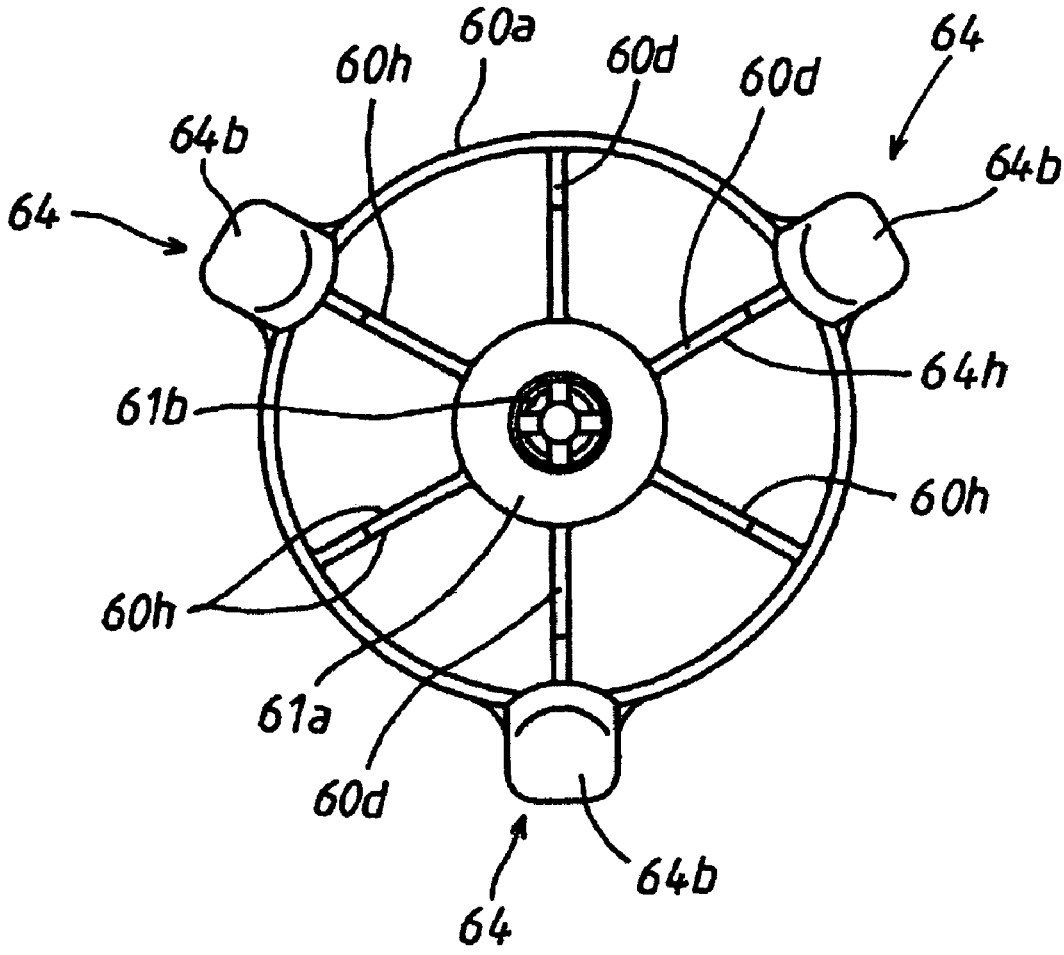
FIG. 10 illustrates a rear view of the cover shown in FIG. 9.

A cover used for a water pump according to a third embodiment will be explained in accordance with FIG. 9 and FIG. 10. In the first embodiment, the paralleled leg portions 63*a* are formed on the attaching portion 63 of the cover 60, and the engaging portions 63*b* are formed in pairs at top end portions of each of the leg portions 63*a* so as to protrude in a circumferential direction of the cover 60. Each of the engaging portions 63*b* extends opposite directions. In the third embodiment, a rubber-single engaging portion 64*b* is fixed at each of the top ends of the leg portions 64*a*. The engaging portion 64*b* includes pawl portion that protrudes inward in a radial direction of the cover 60. The engaging portion 64*b* being elastically deformed is inserted into the engagement hole portion 25*a* of the pulley 20, and then the pawl portion of the engaging portion 64*b* is engaged with the engagement hole portion 25*a* of the pulley 20 outside thereof. Thus, by means of the engaging portion 64*b* that is made of rubber, the rear surface of the bottom surface boss portion 61*a* of the cover 60 can be elastically attached to a front surface (first surface) of the front wall portion 24 of the pulley 20, as a result noise of the cover 60 knocking on the pulley 20 can be prevented. Further, vibration on the pulley 20, which is formed of a steel plate by pressing, can be absorbed by means of engaging portion 64*b* made of rubber, as a result, vibration on the cover 60 caused by the vibration of the rotational fluctuation of the pulley 20 can be effectively reduced.

Figure 13:
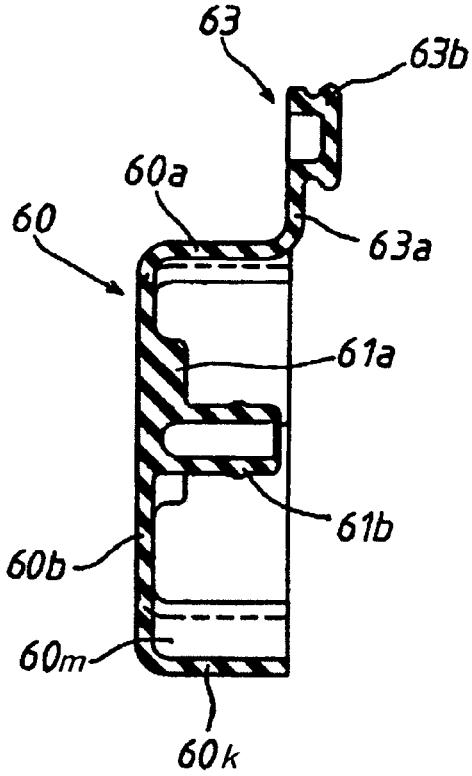
FIG. 13 illustrates a cross section of the cover shown in FIG. 11.
Figure 14:
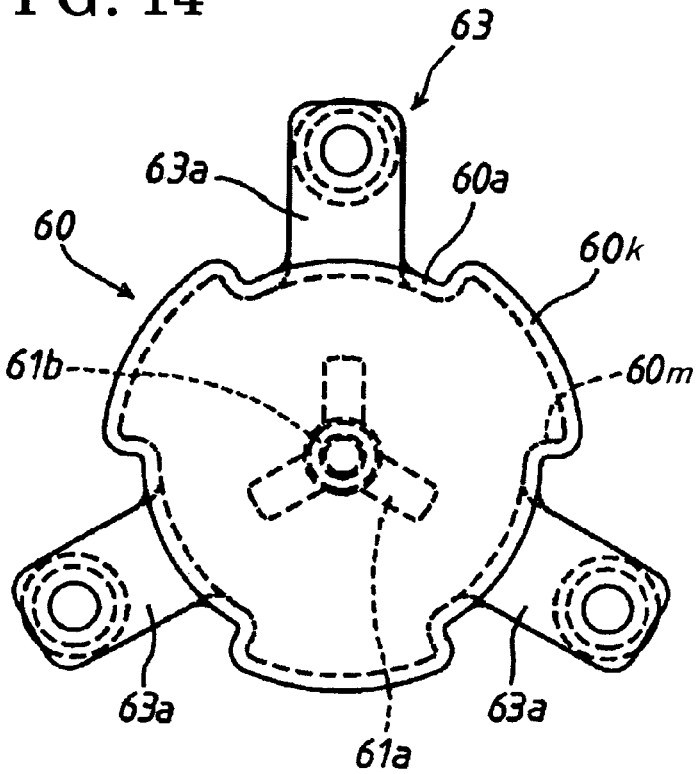
FIG. 14 illustrates a front view of the cover shown in FIG. 13.

A cover used for a water pump according to a fourth embodiment will be explained in accordance with FIGS. 11 to 15. The fourth embodiment basically has a similar structure to that of the first embodiment. The emphasis will be placed on an explanation of differences from the first embodiment. The cover 60 in the fourth embodiment is made of rubber, and in such the configurations, a shape differs from the first embodiment. In the fourth embodiment, as shown in detail in FIGS. 13 to 15, a cylinder portion 60*a* is formed on the outer peripheral portion of the cover 60 in the same manner as the first embodiment. The cylinder portion 60*a* is extending in the rear direction so as to be fitted to the bearing supporting portion 22. Further, at a central portion of the bottom portion 60*b* of the cover 60, three boss portions 61*a* are formed and equally spaced in circumferential direction. Each of the boss portions 61*a* protrudes in a rear direction as shown in FIG. 13 and extends in a radial direction as shown in FIG. 14, so as to engaged with the front wall portion 24 of the pulley 20.

Figure 11:
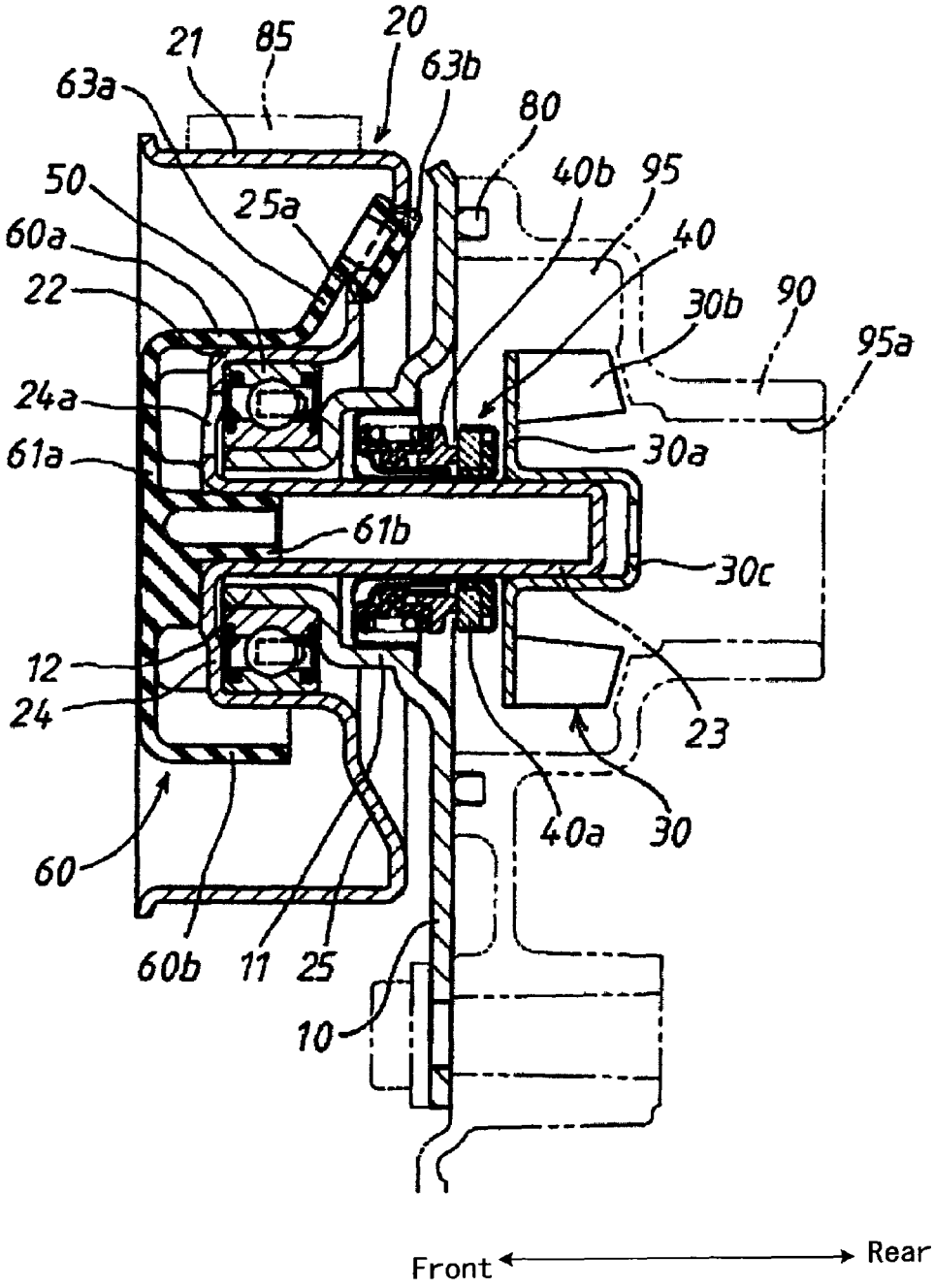
FIG. 11 illustrates a vertical section of the water pump according to a fourth embodiment of the present invention.
Figure 12:
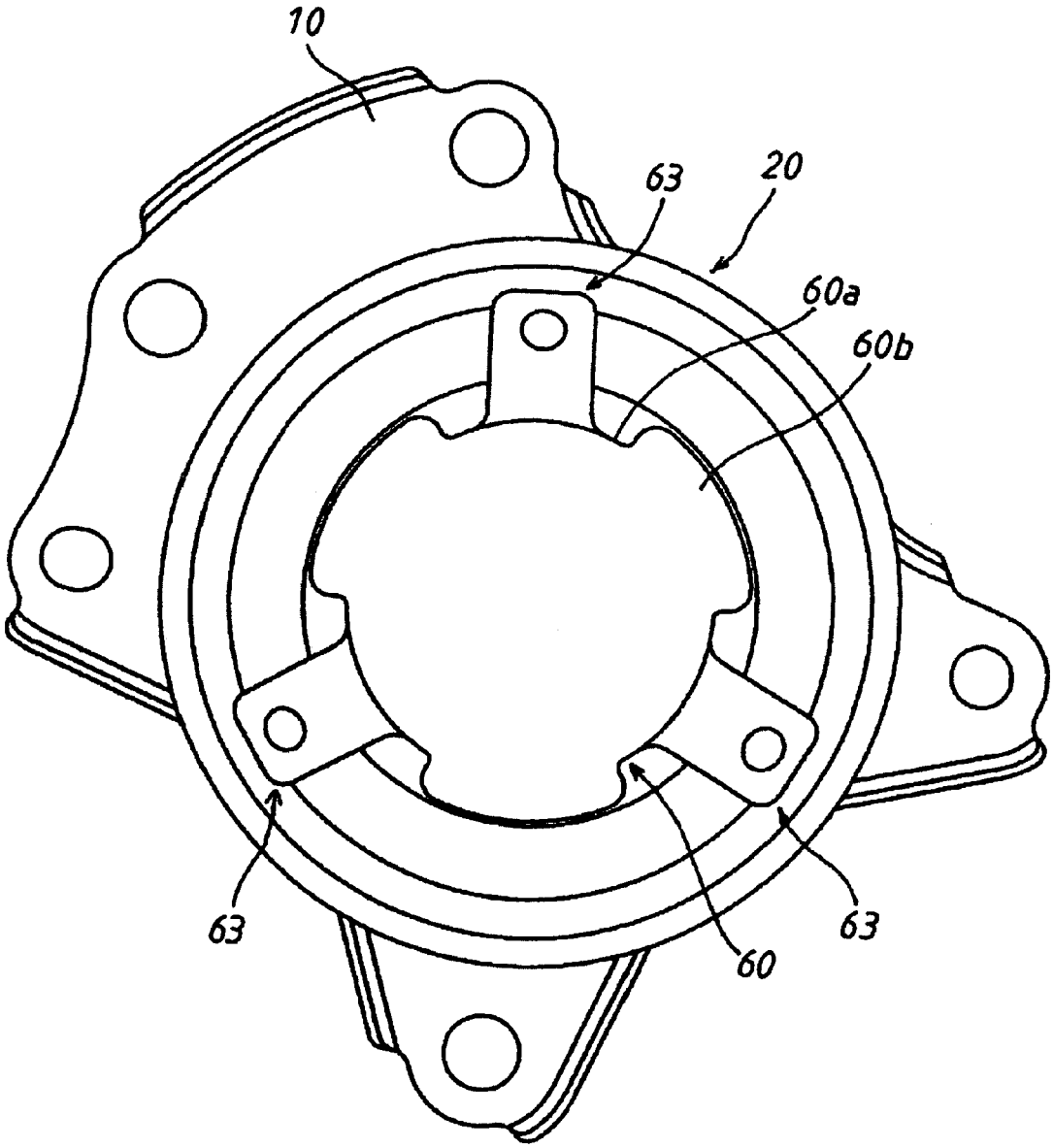
FIG. 12 illustrates a front view of the water pump shown in FIG. 11.
Figure 15:
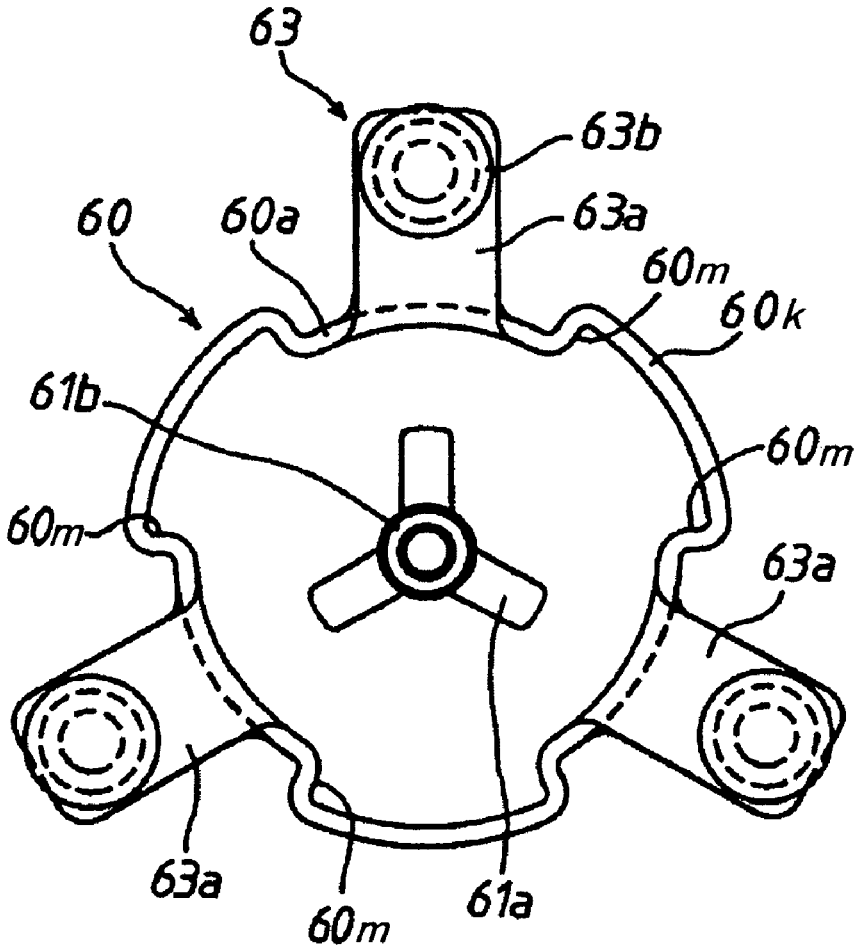
FIG. 15 illustrates a back view of the cover show in FIG. 13.

Outside of the cylinder portion 60*a* of the cover 60, plural attaching portions 63 are formed. In this embodiment, three attaching portions are formed as a first attaching portion so as to engage with the engagement hole portion 25*a* of the pulley 20. Specifically, each of the attaching portions 63 is comprised of a plate type leg portion 63*a* and an engaging portion 63*b* being. The leg portion 63*a* extends from a rear end of the cylinder portion 60*a* in a radial direction, and the engaging portion 63*b* formed on an outer portion of the attaching portion 63*a* as shown in FIG. 15 and protrudes in a rear direction as shown in FIG. 13. The engaging portion 63*b* includes a concaved portion so as to a bottom portion is formed at the rear end thereof, and an opening is formed at the front end thereof as shown in FIG. 11 and FIG. 13, and thus the engaging portion 63*b* is elastically deformable in a radial direction thereof. The leg portion 63*a* is elastically deformable along the rear wall portion 25 of the pulley 20, and in such the state the engaging portion 63*b* is elastically engaged with the engagement hole portion 25*a* as shown in FIG. 11.

Furthermore, at the central portion of the boss portion 61*a*, an insert portion 61*b* is formed. The insert portion 61*b*, serving as a second attaching portion, extends in a rear direction so as to be engaged with the opening of the shaft portion 23. The insert portion 61*b* is formed in a cylindrical shape and includes an opening at the front end thereof as shown in FIG. 11 and FIG. 13. The insert portion 61*b* is elastically deformable in a radial direction thereof so as to be elastically engaged with the opening of the shaft portion 23.

Thus, the cover 60 is fixed to the pulley 20 by means of the plural attaching portions formed on the circumference of the cover 60 and the central portion. The cover 60 is fixed at plural portions on the circumference to the pulley 20 in configurations where the engaging portions 63*b* are inserted into the engagement hole portions 25*a* so as to be elastically engaged therewith. Further, the insert portion 61*b* of the cover 60 is inserted into the opening portion of the shaft portion 23 so as to be elastically engaged therewith, and thus, the central portion of the cover 60 is fitted to the central portion of the pulley 20. In such the configurations where the opening portion of the shaft portion 23 is covered with the insert portion 61*b*, it can be prevented that foreign objects come into the shaft portion 23, and thus, even when the bottom portion inside the shaft portion 23 cannot be appropriately plated or painted in order to apply corrosion resistance, it can be prevented that the bottom portion inside the shaft portion 23 is rusted.

In the fourth embodiment, the three third cylinder portions 60*k* are formed at spaces formed between each one of the three attaching portions 63. More specifically, as shown in a rear view in FIG. 14, the diameter of the cylinder portion 60*a* are increased within the spaces formed between each one of the three attaching portions 63 so as to form three third cylinder portions 60*k*. Further, as show in FIG. 14, wall portions 60*m* are formed between both ends of each of the third cylinder portions 60*k* and the cylinder portion 60*a* so as to extend in a radial direction of the cover 60. The wall surfaces 60*h* serves as the ribs 60*d*, specifically, vaporized coolant or micro-stilliformed coolant and leaked from the pump chamber 95 through the mechanical seal 40 and attached on an inner peripheral surface of the third cylinder portion 60*k*, gathers on the wall portion 60*m* so as to prevent the gel-type ethylene glycol coming out of the pulley 20.

Further, because the cover 60 is made of rubber and mounted to the pulley 20 in circumstances where the boss portion 61*a* is engaged with the front wall portion 24 of the pulley 20, and the cylinder portion 60*a* is fitted to the bearing supporting portion 22, the vibration of the bearing or the rotational fluctuation of the pulley 20 can be effectively reduced.

Thus, according to the present invention, fluid leaked through the seal member gathers on a wall surface (reservoir) of the cover and stays within the cover. In such the configurations, it can be prevented that the fluid flows outside the cover, and it can be prevented that elements in the fluid adhere to a surface of the pulley.

Further, according to the present invention, the fluid, leaked through the seal member and adhered on the inner peripheral surface of the cover so as to be in gel-type, gathers on the wall surface and stays within the cover.

Furthermore, according to the present invention, even when notches are formed on the cylinder portion of the cover for reasons of a manufacturing convenience, the fluid, leaked through the seal member and adhered to the inner peripheral surface of the cover so as to be in gel-type, gathers on the wall surface and stays within the cover.

Still further, according to the present invention, the cover is attached to the pulley by means of the elastic member, it can be prevented that the cover rattles due to a rotational fluctuation of the pulley.

Yet still further, according to the prevent invention, the elastic member is compressed and provided between the front surface of the front wall portion (first wall portion) of the pulley and the bottom surface boss portion of the cover, as a result, rattling does not occur due to wear on a engaging portion the cover, and further, noise of the cover knocking on the pulley does not occur, or else, because of vibration on the pulley resulted from rotational fluctuation, noise does not occur.

In addition, because the small through-hole is covered by the elastic member on the rear surface of the bottom surface boss portion, and the elastic member can be seen from a front surface of the bottom surface boss portion through the through-hole even after the cover is attached to the pulley. Thus, it can be easily prevented that the elastic member has been missed to be attached to the bottom surface boss portion.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the sprit of the present invention. Accordingly, it is expressly intended that all such variations, changes and equivalents which fall within the spirit and scope of the present invention as defined in the claims, be embraced thereby.

The invention claimed is:

1. A water pump comprising:

a pump body including a pump chamber;

a bearing;

a cylindrical supporting portion formed on the pump body so as to protrude;

a pulley rotatably supported by the cylindrical supporting portion by means of the bearing so as to rotate relative to the cylindrical supporting portion;

a shaft portion, including first and second end portions, formed on the pulley so as to penetrate a central hole of the cylindrical supporting portion and extend as far as the pump chamber of the pump body;

an impeller provided at the second end portion of the shaft portion to rotate integrally with the shaft portion;

a seal member provided between an inner peripheral surface of the cylindrical supporting portion at the pump body side and an outer peripheral surface of the second end portion of the shaft portion;

a pulley cylinder portion provided at the pulley and an outer ring of the bearing engaged with the pulley cylinder portion;

a wall portion provided at the pulley to connect the pulley cylinder portion with the first end portion of the shaft portion;

a through-hole formed on the wall portion so as to be penetrated in an axial direction thereof, and a cover covering the wall portion and the pulley cylinder portion of the pulley from one side of the pulley, and the cover formed in a cylindrical shape with a bottom portion and including a reservoir for collecting fluid that has leaked through the seal member, wherein the reservoir is formed on a back side of the bottom portion of the cover in a rib shape which extends in a radial direction and protrudes from the back side of the bottom portion in an axial direction.

2. The water pump according to claim 1, wherein the reservoir includes a wall portion formed on an inner peripheral surface of a cover cylinder portion of the cover, said wall portion extends in the axial direction and protrudes from the inner peripheral surface of the cover in the radial direction.

3. The water pump according to claim 2, wherein notches are formed on the inner peripheral surface of the cover cylinder portion, and the wall surface is positioned between the through-hole and one of the notches formed behind the through-hole in a rotational direction of the pulley.

4. The water pump according to claim 1, wherein the cover is attached to the pulley by means of an elastic member.

5. The water pump according to claim 4, wherein the elastic member is compressed and provided between a first surface of the wall portion of the pulley and a bottom surface boss portion of the cover.

6. The water pump according to claim 5, wherein a hole for confirmation of a presence of the elastic member is formed on the bottom surface boss portion.

7. The water pump according to claim 2, wherein the cover is attached to the pulley by means of an elastic member.

8. The water pump according to claim 3, wherein the cover is attached to the pulley by means of an elastic member.

9. The water pump according to claim 1, wherein the cover is formed of resin.

* * * * *